US005584115A

United States Patent [19]

Takahashi

[11] Patent Number: 5,584,115

[45] Date of Patent: Dec. 17, 1996

[54] METHOD OF MANUFACTURING COMMUTATOR HAVING COMMUTATOR PIECES EACH PROVIDED WITH AXIALLY EXTENDING ENGAGEMENT CLAWS

[75] Inventor: Kouji Takahashi, Toyohashi, Japan

[73] Assignee: Asmo Co., Ltd., Kosai, Japan

[21] Appl. No.: 249,995

[22] Filed: May 27, 1994

[30] Foreign Application Priority Data

Sep. 17, 1993 [JP] Japan ..... 5-231832

[51] Int. Cl.[6] ..... H01R 43/04

[52] U.S. Cl. ..... 29/597; 310/235

[58] Field of Search ..... 29/597, 598; 310/233, 310/234, 235

[56] References Cited

U.S. PATENT DOCUMENTS

| | | | |
|---|---|---|---|
| 3,140,414 | 7/1964 | Skjodt et al. | 310/235 |
| 4,920,633 | 5/1990 | Wojcik | 29/597 |
| 5,204,574 | 4/1993 | Kanno et al. | 310/233 |

FOREIGN PATENT DOCUMENTS

| | | |
|---|---|---|
| 45-5978 | 2/1970 | Japan . |
| 60-175388 | 9/1985 | Japan . |

*Primary Examiner*—Carl E. Hall

*Attorney, Agent, or Firm*—Burns, Doane, Swecker & Mathis, LLP

[57] ABSTRACT

A commutator for electric motors which is highly durable and which can be manufactured at lower cost and by a simpler method includes forming the commutator pieces on the outer periphery of the insulating resin material by providing slits between the commutator pieces. Formed on the inner periphery of the commutator pieces are a pair of engagement claws which face each other and become closer to each other in the radially inwardly extending direction. A filling space part which diminishes in the radially inwardly extending direction is formed between the pair of engagement claws, and an axial end claw which links the pair of engagement claws is formed on the axial end of the commutator piece. Furthermore, a cut part which links the filling space part is formed on the axial end claw in correspondence to the filling space part.

8 Claims, 7 Drawing Sheets

METHOD OF MANUFACTURING COMMUTATOR HAVING COMMUTATOR PIECES EACH PROVIDED WITH AXIALLY EXTENDING ENGAGEMENT CLAWS

BACKGROUND OF THE INVENTION

1. Field of the Invention

The present invention generally relates to a commutator for electric motors and a method for manufacturing the same. More particularly, the present invention relates to a commutator for electric motors of which commutator pieces constituting the commutator are fixed to an insulating material so as not to separate or scatter therefrom during motor rotation and a manufacturing method for the same.

2. Description of Related Art

In a conventional Commutator for electric motors, a cylindrical insulating resin material for electric insulation is filled into a cylindrical conductive material, and a plurality of commutator pieces are formed by forming a plurality of slits on the conductive material in the axial direction thereof to constitute a commutator for electric motors. Furthermore, a latch pin or hook pin is integrally formed at an axial side end of each commutator piece to latch an exciting winding to be wound around a rotor.

It should be noted, however, that commutator pieces of the commutator are subjected to various forces. That is, when an electric motor runs, the commutator also rotates with the rotor, and consequently the commutator pieces constituting the commutator are subjected to centrifugal force. Furthermore, as brushes slidingly contact the commutator pieces, the commutator pieces are subjected to force in the circumferential direction as well. In addition, as the exciting winding is latched on the latch pins, the commutator pieces are subjected to tensile force in the axial direction.

Various structures have been proposed so that the commutator pieces are protected from separation and scatter by those forces, as illustrated in FIGS. 19 through 24.

A commutator 100 illustrated in FIGS. 19 and 20 is composed of a plurality of commutator pieces 102 which are separated from each other by a plurality of slits 101. A pair of folded claws 103 are integrally formed on the axial side ends of the commutator piece 102 respectively, and these folded claws 103 are embedded in an insulating resin material 104.

A commutator 100 illustrated in FIGS. 21 and 22 is also composed of a plurality of commutator pieces 102 which are separated by a plurality of slits 101. A pair of raised claws 105 are formed at the axial side end parts of the inner periphery of the commutator piece 102, and these raised claws 105 are embedded in an insulating resin material 104.

A commutator 100 illustrated in FIGS. 23 and 24 is also composed of a plurality of commutator pieces 102 which are separated by a plurality of slits 101. A plurality of pairs of engagement claws 106 are formed on the inner periphery of each commutator piece 102 at the specified intervals. These engagement claws 106 are embedded in the insulating resin material 104.

However, as the folded claws 103 are made of a sheet of conductive material which is punched and then folded on a press, there is a problem that the yield rate or percentage of use of the conductive material is low. There is another problem that the folded claws 103 may be deformed or broken due to resin forming pressure in the filling of the insulating resin material 104. There is also another problem that, although the commutator piece 102 formed with the folded claws 103 can withstand the tensile force of the exciting winding, it is vulnerable to force in the circumferential direction and centrifugal force.

There is a problem with the commutator 100 illustrated in FIGS. 21 and 22 that the raised claws 105 of the commutator piece 102 may be deformed or broken due to resin forming pressure in the filling of the insulating resin material 104. There is another problem that, although the commutator piece 102 formed with the raised claws 105 can withstand the tensile force of the exciting winding, it is also vulnerable to force in the circumferential direction and centrifugal force.

The commutator 100 illustrated in FIGS. 23 and 24 has a problem that, although each commutator piece 102 can withstand the tensile force of the exciting winding, it is also vulnerable to force in the circumferential direction and centrifugal force. There is another problem that, as the engagement claws 106 of the commutator piece 102 are made by rolling a sheet of conductive material into a cylindrical shape and then forming the slits 101 to divide the conductive material into the commutator pieces 102, a rolling process is required for rolling the conductive material and equipment for this rolling process is additionally required, which requires additional production facility costs.

SUMMARY OF THE INVENTION

Accordingly, it is a primary object of the present invention to solve the above problems.

It is a further object of the invention to provide a commutator which has higher durability by so arranging that commutator pieces are fixed to an insulating resin material not to separate or scatter during rotation.

It is a still further object of the invention to provide a manufacturing method of a commutator which is low in cost and simple in manufacturing process.

According to the present invention, a commutator for electric motors is constructed by arranging a plurality of commutator pieces over an outer periphery of a cylindrical insulating resin material at specified intervals and a pair of engagement claws which face each other in the axial direction of each commutator piece on the inner periphery thereof. The engagement claws become closer to each other, or the circumferential distance therebetween is decreased, as they extend radially inwardly from the commutator piece. A filling space part which dwindles in the radially inwardly extending direction is formed accordingly between the pair of engagement claws. An axial side end claw or circumferential claw which connects the pair of engagement claws is formed circumferentially at an axial end of each commutator piece so that a cut part linked to the filling space part is formed on the axial end claw in correspondence to the filling space part.

As the insulating resin material is filled into the filling space part and the cut part, the pair of engagement claws hold the insulating resin material in the form of wedge engagement. Due to this arrangement, the pair of engagement claws allow each commutator piece to withstand any force in the circumferential direction and centrifugal force. Furthermore, as the insulating resin material is filled into the cut part formed at the axial end claw, the axial end claw is engaged with the insulating resin material. Due to this wedge engagement arrangement, each commutator piece can withstand any tensile force of the exciting winding. Moreover, as the pair of engagement claws and the axial end claw are formed to be integral with each other, each commutator piece can sufficiently withstand any resin forming pressure.

Furthermore, according to the present invention, a commutator for electric motors is constructed by arranging a plurality of commutator pieces over an outer periphery of a cylindrical insulating resin material at specified intervals. A pair of engagement claws which face each other in the axial direction of each commutator piece on the inner periphery thereof and becomes closer to each other as extending inwardly into the insulating resin material are formed. An intermediate claw which expands in circumferential width as extending radially inwardly into the insulating resin material is formed so that a filling space part which dwindles as extending radially inwardly to the insulating resin material is formed between the pair of engagement claws and the intermediate claw. An axial end part claw which connects the pair of engagement claws and the intermediate claw is formed at the axial end of each commutator piece at a position opposite to a latch pin, and a cut part linked to the filling space part is formed on the axial end claw in correspondence to the filling space part.

As the insulating resin material is filled into the filling space part and the cut part, the pair of engagement claws and the intermediate claw hold the insulating resin material. Due to this arrangement which provides a wedge engagement, the pair of engagement claws and the intermediate claw allow each commutator piece to withstand any force in the circumferential direction and centrifugal force. Furthermore, as the insulating resin material is filled into the cut part formed at the axial end claw, the axial end claw is engaged with the insulating resin material. Due to this wedge engagement arrangement, each commutator piece can withstand any tensile force of the exciting winding. Moreover, as the pair of engagement claws, the intermediate claw and the axial end claw are formed to be integral with each other, each commutator piece can sufficiently withstand any resin forming pressure.

Furthermore, according to the present invention, a method for manufacturing a commutator is provided by arranging a cylindrical insulating resin material over an inner periphery of a cylindrical conductive material and forming a plurality of commutator pieces by forming a plurality of slits in the conductive material in the axial direction thereof. The conductive material is so arranged that one axial end thereof from which a latch pin extends outwardly protrudes from a guide mold which supports the other axial end and outer periphery of the conductive material. A columnar intermediate mold provided with grooves to form engagement claws in correspondence with each commutator piece is inserted into the inner periphery of the conductive material. A part of the conductive material is filled into the grooves formed on the intermediate mold by pressurizing the one axial end of the conductive material protruded from the guide mold by means of a pressure mold sliding against the intermediate mold to form a pair of engagement claws which become closer to each other as extending radially inwardly in correspondence to each commutator piece on the inner periphery of the conductive material. An intermediate claw which expands as extending radially inwardly in the axial direction of the conductive material is formed between the pair of engagement claws to form a filling space part which dwindles as extending inwardly between the pair of engagement claws and the intermediate claw, an axial end claw which connects the pair of engagement claws and the intermediate claw is formed at the one axial end of the conductive material, and a cut part which links to the filling space part is formed at the axial end claw in correspondence to the filling space part.

Consequently, the pair of engagement claws in each commutator piece which becomes closer to each other as extending radially inwardly are formed on the inner periphery of the conductive material. On the other hand, the intermediate claw is formed on the inner periphery of the conductive material between the pair of engagement claws. As a result, the filling space part which dwindles in the inward radial direction is formed between the pair of engagement claws and the intermediate claw. Furthermore, the axial end claw which links the pair of engagement claws and the intermediate claw is formed at the other axial end of the conductive material, and the cut part which links to the filling space part is formed at the axial end claw in correspondence to the filling space part.

DETAILED DESCRIPTION OF THE PREFERRED EMBODIMENTS

There will now be described preferred embodiments according to the present invention with reference to the accompanying drawings, FIGS. 1 through 17 in particular.

Figure 1:
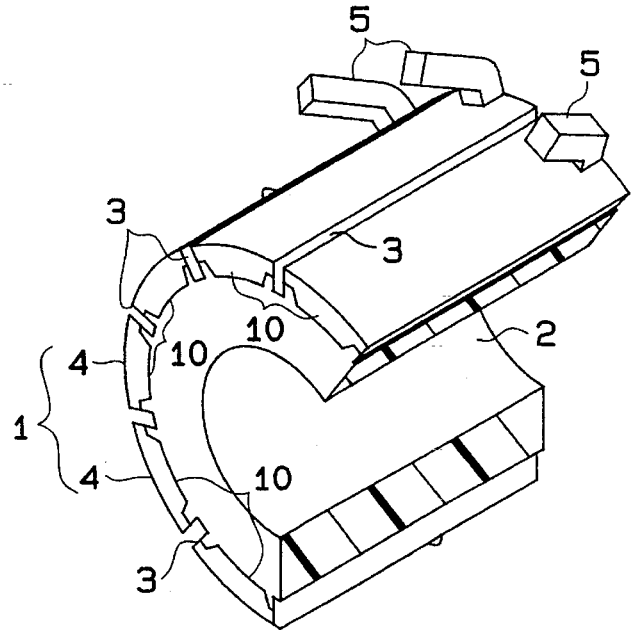
FIG. 1 is a perspective view partly in section illustrating a whole structure of a commutator for electric motors according to an embodiment of the present invention.
Figure 2:
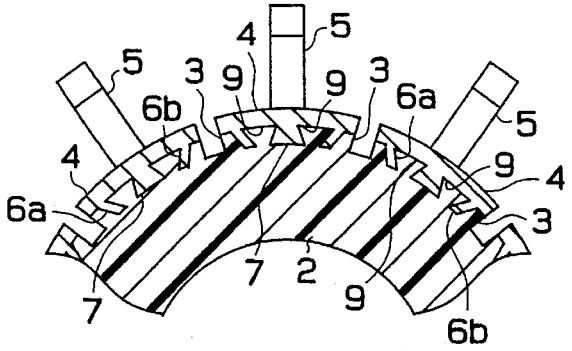
FIG. 2 is a partial sectional view illustrating commutator pieces fixedly attached to an outer periphery of an insulating resin material.

As illustrated in FIG. 1, a generally cylindrical insulating resin material 2 is attached to the inner periphery of a cylindrical conductive copper material 1. The insulating resin material 2 is so designed that a rotary shaft of an electric motor (not illustrated) can be fixedly penetrated therethrough. A plurality of slits 3 are formed in the conductive material 1 in the axial direction at specified regular or equal circumferential intervals.

These slits 3 divide the conductive material 1 into a plurality of parts which are electrically insulated from each other. These divisions constitute commutator pieces 4. Therefore, a plurality of commutator pieces 4 are fixedly attached to the outer periphery of the cylindrical insulating resin material 2. A latch pin or hook pin 5 is integrally formed at one axial side end of each commutator piece 4 to latch an exciting winding (not illustrated).

Description will now be made with respect to the structure of each commutator piece 4 fixedly attached to the outer periphery of the insulating resin material 2.

Figure 3:
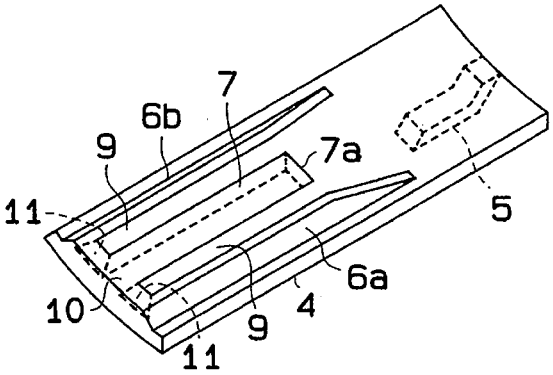
FIG. 3 is a perspective view illustrating shape of each commutator piece.
Figure 4:
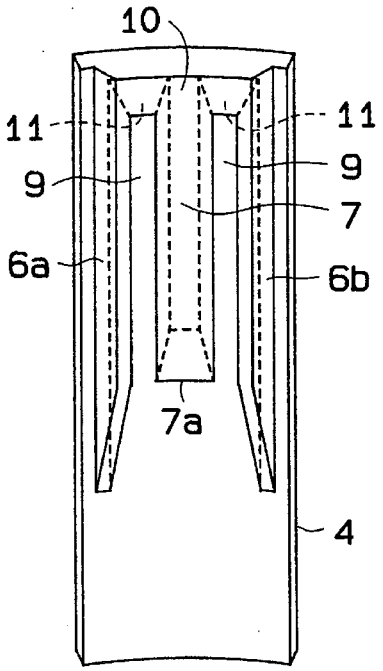
FIG. 4 is a front view illustrating an inner periphery of the commutator piece.
Figure 5:
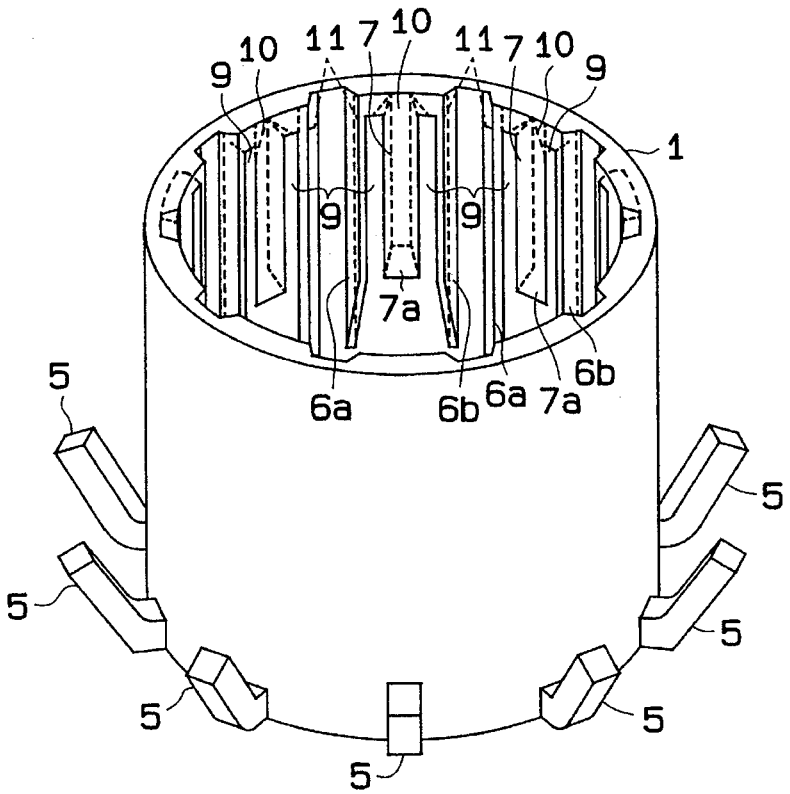
FIG. 5 is a perspective view illustrating a pair of engagement claws, an intermediate claw and an axial end claw formed on a conductive material.
Figure 6:
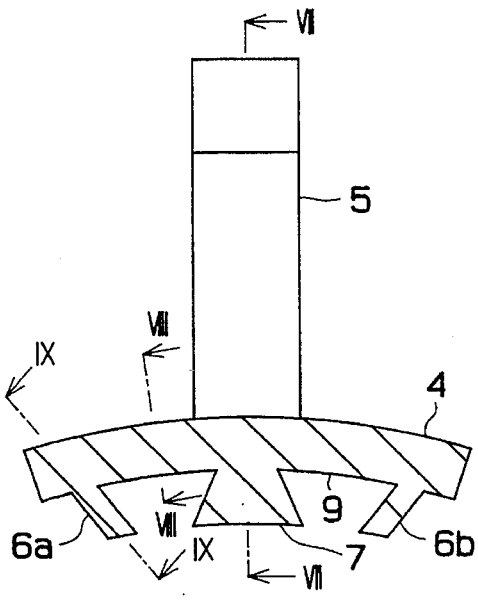
FIG. 6 is a partial sectional view illustrating a pair of engagement claws and an intermediate claw formed on the inner periphery of the commutator piece.
Figure 7:
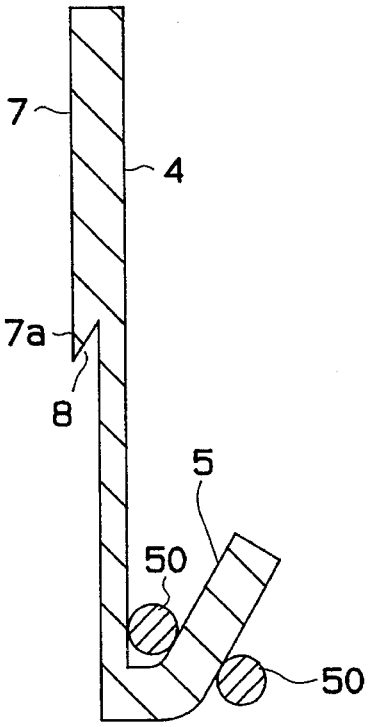
FIG. 7 is a cross-sectional view taken along the line VII—VII of FIG. 6.
Figure 8:
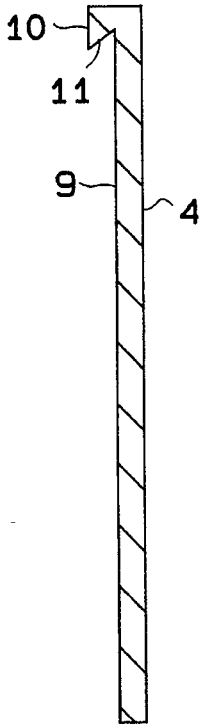
FIG. 8 is a cross-sectional view taken along the line VIII—VIII of FIG. 6.
Figure 9:
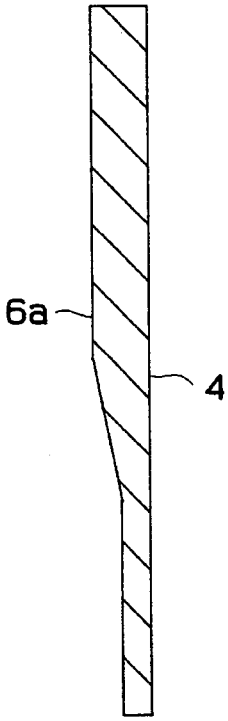
FIG. 9 is a cross-sectional view taken along the line IX—IX of FIG. 6.

As illustrated in FIGS. 2 through 9, a pair of longitudinally or axially extending engagement claws 6*a* and 6*b* facing each other are integrally formed on the inner periphery of each commutator piece 4 in the axial direction of the commutator piece 4 from around the axial central part to the axial side end thereof which is opposite to the one side end where the latch pin 5 is provided. As best illustrated in FIGS. 3, 4 and 9, the pair of engagement claws 6*a* and 6*b* are also slantly formed to axially dwindle or reduce its height as extending from around the axial central part toward the axial side end where the latch pin 5 is provided. Furthermore, an axially extending intermediate claw 7 is integrally formed on the inner periphery of the commutator piece 4 from around the central part to the axial end thereof in the intermediate position between and in parallel with the pair of the engagement claws 6*a* and 6*b*. The intermediate claw 7 is formed as a trapezoid in circumferential cross section which expands in the radial inward direction, i.e. to the insulating resin material 2, as best seen in FIGS. 4 and 5. In addition, a claw part 7*a* with an acute edge is formed at the free end part of the intermediate claw 7, whereby an acute cut space 8 is formed at the lower end of the intermediate claw 7 as best seen in FIGS. 4 and 7.

On the other hand, filling space parts 9 are formed between the pair of engagement claws 6*a* and 6*b* and the intermediate claw 7 in the axial direction of the commutator piece 4. The filling space parts 9 are formed as trapezoids in circumferential cross section which become narrower as they extend radially inwardly to the insulating resin material 2.

A circumferential claw or axial end claw 10 is integrally formed on the inner periphery of the axial side end part of the commutator piece 4 in the circumferential direction to link the pair of engagement claws 6*a* and 6*b* to the intermediate claw 7. As understood from FIG. 8, cut parts 11 are formed at the axial end claw 10 in correspondence to the filling space parts 9. The cut parts 11 are formed so as to cut into the axial end claw 10 from the filling space parts 9.

Accordingly, by filling the insulating resin material 2 into the filling space parts 9, the cut parts 11 and the cut space part 8, the pair of the engagement claws 6*a* and 6*a*, the intermediate claw 7, the claw part 7*a* and the axial end claw 10 are embedded completely in the insulating resin material 2 to provide wedge engagement. Due to this arrangement, the pair of the engagement claws 6*a* and 6*a*, the intermediate claw 7, the claw part 7*a* and the upper part claw 10 jointly hold the insulating resin material 2 so firmly that the commutator piece 4 can not be separated from the insulating resin material 2 during motor rotation.

Next, a method of forming the pair of the engagement claws 6*a* and 6*b*, the intermediate claw 7, the claw part 7*a* and the axial end claw 10*a* and a mold for forming the same will be described.

As illustrated in FIGS. 10 through 13, a guide hole 16 is formed through a lower part supporting mold 15 to insert the cylindrical conductive material 1 thereinto and guide the outer periphery thereof. A cylindrical supporting mold 17 which constitutes a guide mold to support the lower end of the conductive material 1 is inserted into the guide hole 16 from the lower end of the lower support mold 15. A pin mold 18 which constitutes a cylindrical guide mold contacting the inner periphery of the conductive material 1 and inserted into the conductive material 1 is arranged above the lower part supporting mold 15. Furthermore, a pressure mold 19 is slidably installed on the pin mold 18 to pressurize the upper end of the conductive material 1.

As illustrated in FIGS. 14 through 17, a pair of engagement claw forming grooves 20*a* and 20*b* are formed on the outer periphery of the pin mold 18 in the axial direction thereof to form the pair of engagement claws 6*a* and 6*b*. The pair of engagement claw forming grooves 20*a* and 20*b* are formed so that they become closer to each other as they extend radially inwardly to the center of the pin mold 18. On the other hand, an intermediate claw forming groove 21 is formed in the intermediate position between the pair of engagement claw forming grooves 20*a* and 20*b* in the axial direction thereof to form the intermediate claw 7. The intermediate claw forming groove 21 is formed so as to expand as towards the center of the pin mold 18.

Accordingly, space part forming project parts 22 are formed between the engagement claw forming grooves 20*a* and 20*b* and the intermediate claw forming groove 21 respectively to form the filling space parts 9. The space part filling project parts 22 are formed so as to dwindle as they extend towards the center of the pin mold 18. A cut part forming claw 23 is acutely formed at the upper part of the intermediate claw forming groove 21.

On the other hand, cut part forming claws 24 are acutely formed at the lower end of the space part forming project parts 22. These cut part forming claws 24 are formed shorter than the lower end surface of the pin mold 18. The engagement claw forming grooves 20*a* and 20*b* and the intermediate claw forming groove 21 are connected at the lower end of the pin mold 18 in the circumferential direction to form an axial end claw forming groove 25 for forming the axial end claw 10.

Figure 10:
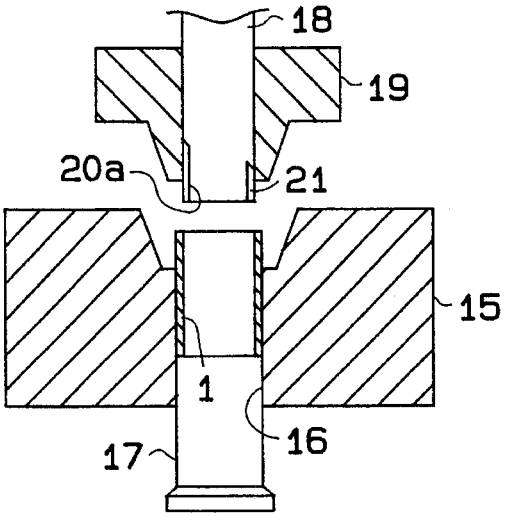
FIG. 10 is a schematic view illustrating a first process for forming the pair of engagement claws, the intermediate claw and the axial end claw on the inner periphery of the conductive material in correspondence to each commutator piece.

Referring back to FIGS. 10 through 13, the conductive material 1 in a cylindrical form is first inserted into the guide hole 16 in the lower part supporting mold 15, then guided at the outer periphery thereof by the lower part supporting mold 15 and at the same time supported at the lower end thereof by the supporting mold 17. At this time, as illustrated in FIG. 10, the insertion amount of the supporting mold 17 into the guide hole 16 is so adjusted that the upper end of the conductive material 1 where the latch pins 5 are provided is kept protruded from the lower part supporting mold 15.

Figure 11:
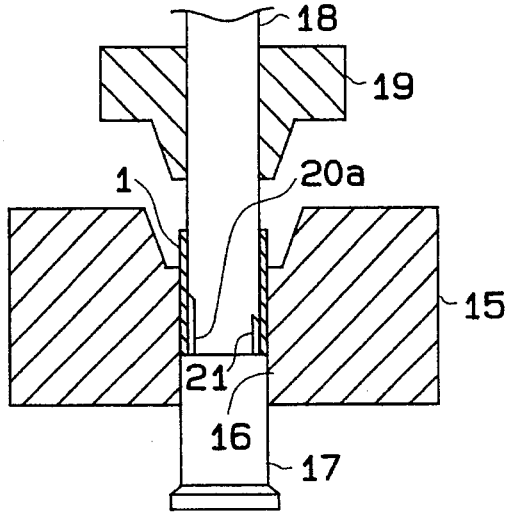
FIG. 11 is a schematic view illustrating a second process for forming the pair of engagement claws, the intermediate claw and the axial end claw on the inner periphery of the conductive material in correspondence to each commutator piece.
Figure 12:
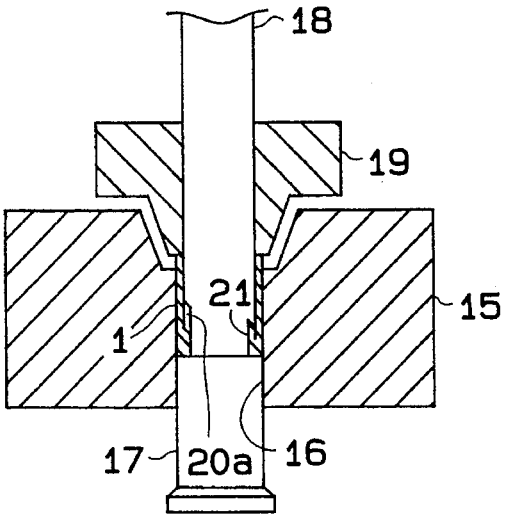
FIG. 12 is a schematic view illustrating a third process for forming the pair of engagement claws, the intermediate claw and the axial end claw in the inner periphery of the conductive material in correspondence to each commutator piece.
Figure 13:
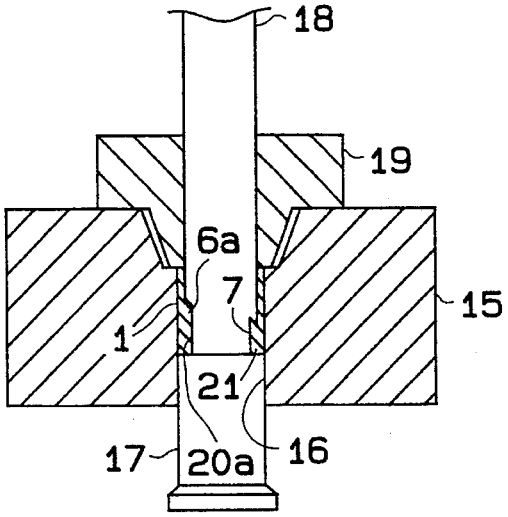
FIG. 13 is a schematic view illustrating a fourth process for forming the pair of engagement claws, the intermediate claw and the axial end part claw on the inner periphery of the conductive material in correspondence to each commutator piece.
Figure 14:
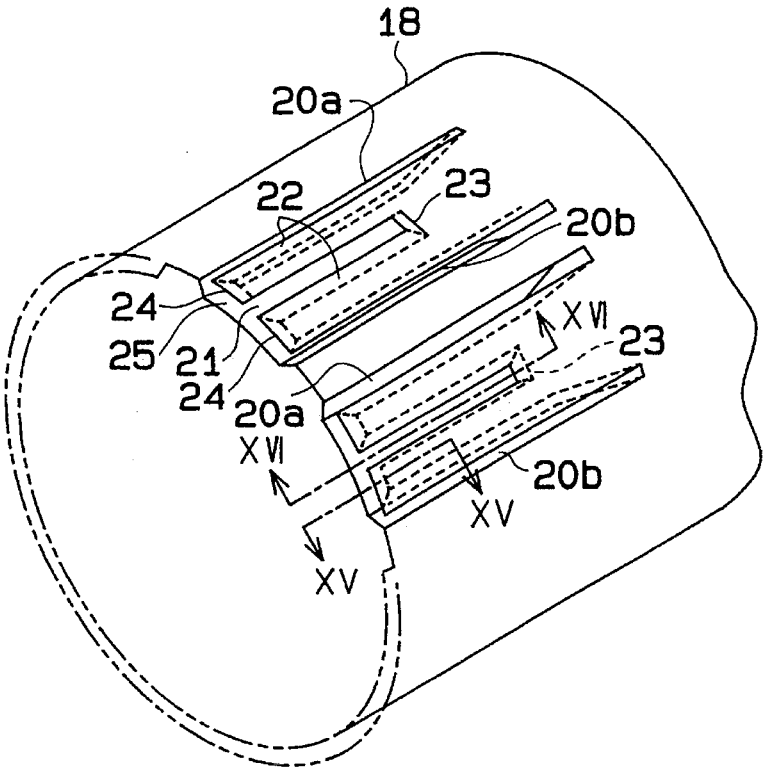
FIG. 14 a perspective view illustrating shape of each groove formed on a lower end outer periphery of a pin mold.
Figure 15:
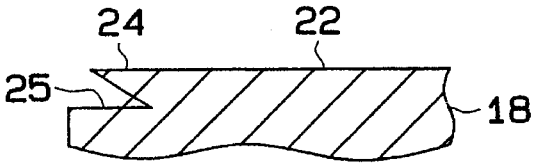
FIG. 15 is a cross-sectional view taken along the line XV—XV of FIG. 14.
Figure 16:
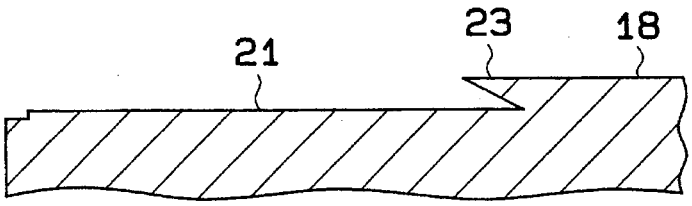
FIG. 16 is a cross-sectional view taken along the line XVI—XVI of FIG. 14.
Figure 17:
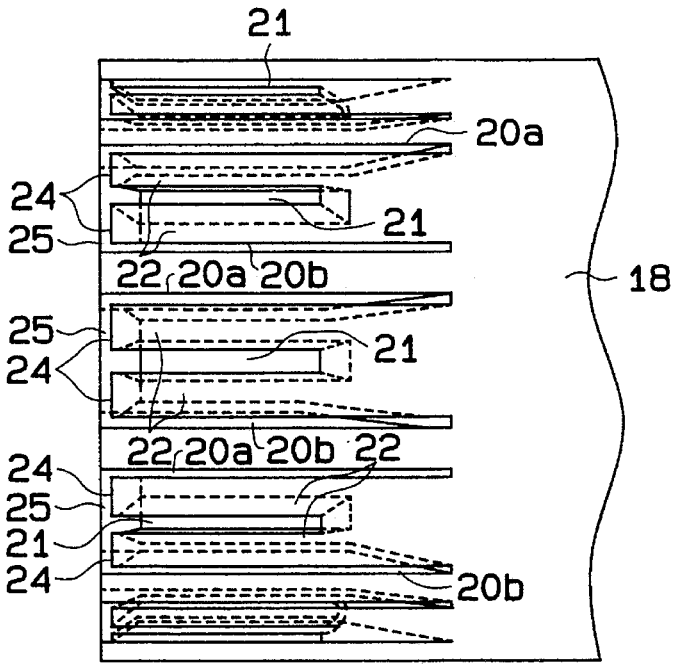
FIG. 17 is a partial side view illustrating the shape of each groove formed on the lower end outer periphery of the pin mold.

Then, as illustrated in FIG. 11, the pin mold 18 is inserted into the conductive material 1 until the lower end surface of the pin mold 18 contacts the upper end surface of the supporting mold 17. Furthermore, as illustrated in FIGS. 12 and 13, the pressure mold 19 is slid downward along the pin mold 18 to pressurize the upper end of the conductive material 1. As this pressurization proceeds, due to plastic deformation by forging with the pressure mold 19, part of the conductive material 1 flows into the engagement claw forming grooves 20*a* and 20*b*, the intermediate claw forming groove 21 and the axial end part claw forming groove 25.

As a result, the pair of engagement claws 6*a* and 6*b*, the intermediate claw 7 and the axial end claw 10 are integrally formed at the same time on the inner periphery of the conductive material 1 at the bottom or axial end portion opposite to the end portion where the latch pin 5 is formed for each commutator piece 4. Furthermore, the claw part 7*a* is integrally formed at the lower end of the intermediate claw 7 by the cut forming claw 23. On the other hand, the cut part 11 is formed at the upper part claw 10 in correspondence to the filling space part 9 by the cut part forming claws 24 formed at the lower end of the space part forming project 22.

Moreover, after the above process, the latch pins 5 are integrally formed on the conductive material 1 in correspondence to the commutator pieces 4 respectively as illustrated in FIG. 5. Then, the inner periphery of the conductive material 1 is filled with the insulating resin material 2. Then, slits 3 are formed in the conductive material 1 in the axial direction thereof to divide the conductive material 1 into a plurality of parts to form the commutator pieces 4 over the outer periphery of the insulating resin material 2.

Accordingly, the pair of engagement claws 6*a* and 6*b*, the intermediate claw 7 and the axial end claw 10 are integrally formed on the inner periphery of the conductive material 1 for each commutator piece 4 in one process. This simplifies the manufacturing method for manufacturing a commutator and at the same time lowers the manufacturing cost.

When the insulating resin material 2 is filled into the inner periphery of the conductive material 1, the insulating resin material 2 flows into the cut parts 11 in the axial end part claw 10 and the cut space part 8 in the intermediate claw 7 due to resin forming pressure. As a result, the pair of engagement claws 6*a* and 6*b* and the intermediate claw 7 jointly hold the insulating resin material 2 in the circumferential direction of the insulating resin material 2.

In addition, as the insulating resin material 2 fills the cut parts 11 and the cut space part 8, the axial end claw 10 and the insulating resin material 2 are engaged in the axial direction of the insulating resin material 2 and the claw part 7*a* and the insulating resin material 2 are engaged in the axial direction of the insulating resin material 2.

Accordingly, when the commutator rotates, each commutator piece 4 is subjected to centrifugal force in the radial direction of the insulating resin material 2. At the same time, when slidingly contacting brushes, each commutator piece 4 is also subjected to force in the circumferential direction. At this time, as the pair of engagement claws 6*a* and 6*b* and the intermediate claw 7 jointly hold the insulating resin material 2 in the wedge engagement manner in the circumferential direction thereof, each commutator piece 4 can withstand the centrifugal force.

On the other hand, each commutator piece 4 is subjected to tensile force in the axial direction of the insulating resin material 2 due to an exciting winding 50 latched by the latch pins 5. At this time, however, as the axial end claw 10 and the intermediate claw 7 are also fixed to the insulating resin material 2 in the wedge engagement manner in the axial direction by means of the cut parts 11 and the cut space parts 8 respectively, each commutator piece 4 can withstand the tensile force.

As a result of the above, each commutator piece 4 can withstand all the force in the circumferential direction, centrifugal force and tensile force applied thereto, it can be so arranged that each commutator piece 4 can not separate or scatter from the outer periphery of the insulating resin material 2 during motor rotation.

Furthermore, as the pair of engagement claws 6*a* and 6*b*, the intermediate claw 7 and the axial end claw 10 are integrally formed on the inner periphery of each commutator piece 4, these claws can be kept protected from deformation or breakage due to the resin forming pressure of the insulating resin material 2. Consequently, each commutator piece 4 can be kept fixedly attached to the insulating resin material 2 in a stable condition.

The pair of engagement claws 6*a* and 6*b*, the intermediate claw 7 and the axial end claw 10 formed on each commutator piece 4 can practically be set to approximately 1 mm in height in the radial direction. Therefore, the thickness of the insulating resin material 2 can be reduced, whereby the commutator can be down-sized.

Moreover, as the pair of engagement claws 6*a* and 6*b*, the intermediate claw 7 and the axial end claw 10 can be lowered in height, these claws can be protected from deformation or breakage due to the resin forming pressure of the insulating resin material 2.

As a result, as the pair of engagement claws 6*a* and 6*b*, the intermediate claw 7 and the axial end claw 10 formed on each commutator piece 4 are engaged with the insulating resin material 2, it can be so arranged that each commutator piece 4 can not separate or scatter from the outer periphery of the insulating resin material 2.

In this embodiment, the intermediate claw 7 is formed between the pair of engagement claws 6*a* and 6*b*. If necessary, however, this intermediate claw 7 may be omitted.

Figure 18:
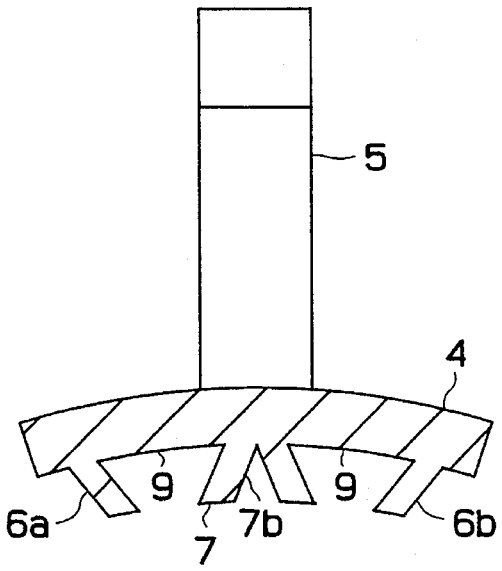
FIG. 18 is a partial cross-sectional view illustrating the shape of a commutator piece of an alternative embodiment of the present invention.
Figure 19:
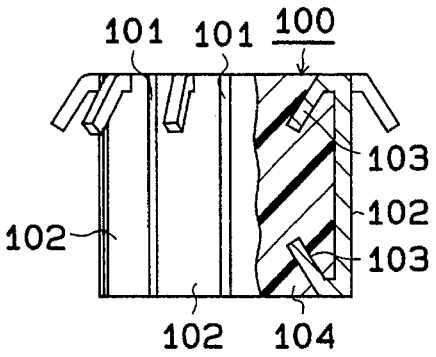
FIG. 19 PRIOR ART
FIG. 19 is a partial cross-sectional view illustrating a conventional commutator.
Figure 20:
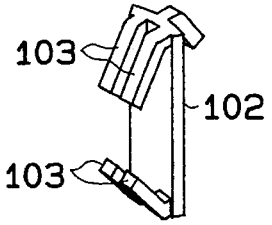
FIG. 20 PRIOR ART
FIG. 20 is a perspective view illustrating the shape of a commutator piece illustrated in FIG. 19.
Figure 21:
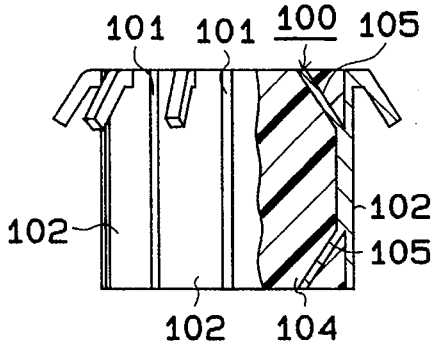
FIG. 21 PRIOR ART
FIG. 21 is a partial cross-sectional view illustrating another conventional commutator.
Figure 22:
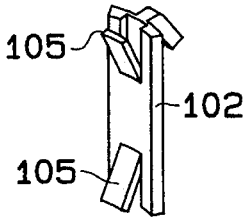
FIG. 22 PRIOR ART
FIG. 22 is a perspective view illustrating the shape of a commutator piece illustrated in FIG. 21.
Figure 23:
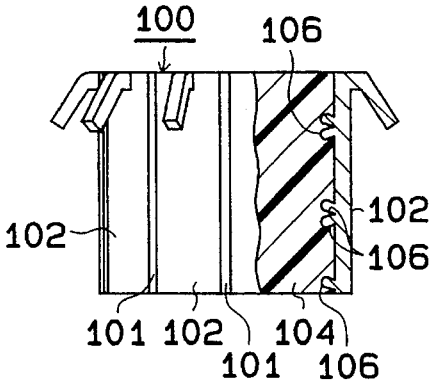
FIG. 23 PRIOR ART
FIG. 23 is a partial cross-sectional view illustrating a further conventional commutator.
Figure 24:
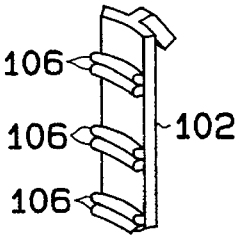
FIG. 24 PRIOR ART
FIG. 24 is a perspective view illustrating the shape of a commutator piece illustrated in FIG. 23.

On the other hand, as illustrated as an alternative embodiment in FIG. 18, a V-groove 7*b* may be formed in the intermediate claw 7 to increase the contact area of each commutator piece 4 and insulating resin material 2 to prevent the separation thereof.

In this embodiment, the tubular conductive material 1 is used. It may be acceptable, however, that a conductive plate is curved into a cylinder and used as the conductive material 1 for forming each commutator piece 4.

As described in depth in the above, it is possible as excellent advantages of the present invention to manufacture commutators at lower cost and by simpler method and at the same time obtain higher durability by so arranging that the commutator pieces are fixed to the insulating resin material not to scatter.

The present invention is not restrictive to the above embodiments, but may be modified in other specific forms without departing from the spirit or essential features thereof.

I claim:

1. A method of manufacturing a commutator for electric motors comprising the steps of:

inserting a cylindrical conductive member into a guide hole of a guide mold and supporting the cylindrical conductive member in the guide hole with an upper axial end of said cylindrical conductive member protruding from said guide mold;

inserting a columnar mold pin axially into said cylindrical conductive member, said mold pin being provided on its circumferential surface with a plurality of axial grooves extending from a bottom of said mold pin and with a circumferential groove which connects said axial grooves circumferentially at said bottom of said mold pin; and sliding a pressure mold downwardly along said mold pin and pressing said cylindrical conductive member axially downwardly so that material forming said cylindrical conductive member flows into said axial grooves and said circumferential groove to provide a plurality of axial claws and a circumferential claw which extend radially inwardly from an inner surface of said cylindrical conductive member.

2. A method according to claim 1, wherein a circumferential distance between the axial grooves decreases in a radially inwardly extending direction.

3. A method according to claim 1, wherein said circumferential groove possesses an axial length that increases in a radially inward direction.

4. A method according to claim 1, further comprising the step of:

filling an insulating material into said cylindrical conductive member to fixedly hold said cylindrical conductive member with respect to the insulting material through wedge engagement.

5. A method according to claim 1, wherein said axial grooves comprise:

a pair of grooves extending axially and parallel to one another from both circumferential ends of said circumferential groove of said mold pin; and an intermediate groove extending axially and parallel to said pair of grooves and from a circumferential center of said bottom of said mold pin.

6. A method according to claim 5, wherein a circumferential distance between said pair of grooves varies and said intermediate groove has a circumferential groove width that gradually widens in the radially inward direction.

7. A method according to claim 6, wherein said intermediate groove has at an axial end opposite said bottom of said mold pin an axial end portion whose axial length gradually increases in the radially inward direction.

8. A method according to claim 6, wherein said pair of grooves each have at an axial end opposite said bottom of said mold pin an axial end portion whose axial length gradually decreases in the radially inward direction.

* * * * *